US005920997A

United States Patent [19]

Girtman

[11] Patent Number: 5,920,997

[45] Date of Patent: Jul. 13, 1999

[54] AUTOMATICALLY RETRACTABLE CHALK LINE DEVICE

[76] Inventor: Michael L. Girtman, #8 Belleau Lake Ct., O'Fallon, Mo. 63366

[21] Appl. No.: 08/901,760

[22] Filed: Jul. 28, 1997

[51] Int. Cl.[6] ..... B44D 3/38

[52] U.S. Cl. ..... 33/414; 242/375.3; 242/385.4

[58] Field of Search ..... 33/413, 414, 767; 242/375.3, 381.6, 385.4

[56] References Cited

U.S. PATENT DOCUMENTS

| | | | |
|---|---|---|---|
| 282,476 | 7/1883 | Williams | 242/375.3 |
| 1,272,270 | 7/1918 | Järviö | 33/414 |
| 2,181,141 | 11/1939 | Lovegran | 242/375.3 |
| 4,068,383 | 1/1978 | Krebs | 242/385.4 |
| 4,121,785 | 10/1978 | Quenot | 33/767 |
| 4,197,656 | 4/1980 | Lane et al. | 33/414 |
| 4,565,011 | 1/1986 | Karger | 33/414 |
| 4,765,557 | 8/1988 | Kahmann | 242/381.6 |
| 5,014,437 | 5/1991 | Sun | 33/414 |
| 5,042,159 | 8/1991 | Millen | 33/414 |

FOREIGN PATENT DOCUMENTS

| | | | |
|---|---|---|---|
| 15147 | of 1910 | United Kingdom | 242/375.3 |

*Primary Examiner*—G. Bradley Bennett
*Attorney, Agent, or Firm*—Henry W. Cummings

[57] ABSTRACT

In accordance with the present invention an automatically retractable chalk line device is provided having a housing in which a power spring drives a first large diameter gear through a first shaft. The first large diameter gear is in driving engagement with a first smaller diameter gear located below the power spring. The first smaller diameter gear drives a second large diameter gear located partially above the power spring. The second large diameter gear drives a second smaller diameter gear which a drives a chalk retaining spool, which holds the chalk line. The relative diameters of the two large diameter gears as compared with the diameter of the two small diameter gears provides a large mechanical advantage. A disc brake is mounted for braking engagement with one of the large diameter gears, preferably the second large diameter gear. An arrangement for engaging and disengaging the disc brake with the large diameter gear is provided. This arrangement includes a cam surface and a slotted plate which is resiliently biased into the engaged position by the cam surface. A release button is actuated to move the plate relative to the cam surface to release engagement between the disc brake and the large diameter gear. The housing for the chalk line retraction device includes an opening in which a plate is movable between an open and closed position to allow for introducing chalk into the assembly adjacent to chalk line. The housing is provided with an exit portion where the chalk line exits and an anchor is provided at the end of the chalk line. The strong power spring and the mechanical advantage achieved from the dual large gear and dual small gear assembly provides a large mechanical advantage to enable a longer chalk line of up to a hundred feet or more to be utilized. The disc brake acting on a large diameter gear provides very effective braking of the system. The deactivation device for the brake system is readily accessible and convenient to operate. Chalk is readily inserted into the housing through sliding plate assembly for loading and unloading chalk.

16 Claims, 4 Drawing Sheets

AUTOMATICALLY RETRACTABLE CHALK LINE DEVICE

FIELD OF THE INVENTION

This invention relates to chalk line devices and in particular to an automatically retractable chalk line device.

BACKGROUND OF THE INVENTION

U.S. Pat. Nos. 4,197,656 and 4,565,011 disclose automatically retractable chalk line devices having three independent axis of rotation. However, neither of these patents locate the shafts on opposite sides of the device for balance. Furthermore, neither of these devices utilizes a disc brake which operates on an auxiliary gear to affect braking of the device.

U.S. Pat. No. 4,121,785 discloses a single axis chalk line device in which a disc brake assembly is utilized. A push button member 14 integral with the shaft 15 engages projections 18 as a partial disc brake braking arrangement. However, in the '785 Patent the disc brake arrangement does not act on a separate auxiliary gear.

SUMMARY OF THE INVENTION

A. Objects of the invention

One object of the present invention is to provide an automatically retractable chalk line device, in which a chalk line of greater length may be utilized.

Another object of the present invention is to provide a three axis design in which the axis's are selected to provide balance in the device.

Another object of the present invention is to provide a disc brake arrangement in which the disc acts on an auxiliary gear.

Another object of the present invention is to utilize large diameter gears and smaller diameter gears to obtain a high gear ratio.

Another object of the present invention is provide a convenient to use brake release assembly.

Other objects will be apparent from the following descriptions and drawings.

B. Summary

In accordance with the present invention an automatically retractable chalk line device is provided having a housing in which a power spring drives a first large diameter gear through a first shaft. The first large diameter gear is in driving engagement with a first smaller diameter gear located below the power spring. The first smaller diameter gear drives a second large diameter gear located partially above the power spring. The second large diameter gear drives a second smaller diameter gear which a drives a chalk retaining spool, which holds the chalk line. The relative diameters of the two large diameter gears as compared with the diameter of the two small diameter gears provides a large mechanical advantage. A disc brake is mounted for braking engagement with one of the large diameter gears, preferably the second large diameter gear. An arrangement for engaging and disengaging the disc brake with the large diameter gear is provided. This arrangement includes a cam surface and a slotted plate which is resiliently biased into the engaged position by the cam surface. A release button is actuated to move the plate relative to the cam surface to release engagement between the disc brake and the large diameter gear. The housing for the chalk line retraction device includes an opening in which a plate is movable between an open and closed position to allow for introducing chalk into the assembly adjacent to chalk line. The housing is provided with an exit portion where the chalk line exits and an anchor is provided at the end of the chalk line. The strong power spring and the mechanical advantage achieved from the dual large gear and dual small gear assembly provides a large mechanical advantage to enable a longer chalk line of up to a hundred feet or more to be utilized. The disc brake acting on a large diameter gear provides very effective braking of the system. The deactivation device for the brake system is readily accessible and convenient to operate. Chalk is readily inserted into the housing through sliding plate assembly for loading and unloading chalk.

THE DRAWINGS

DESCRIPTION OF PREFERRED EMBODIMENTS

Figure 1:
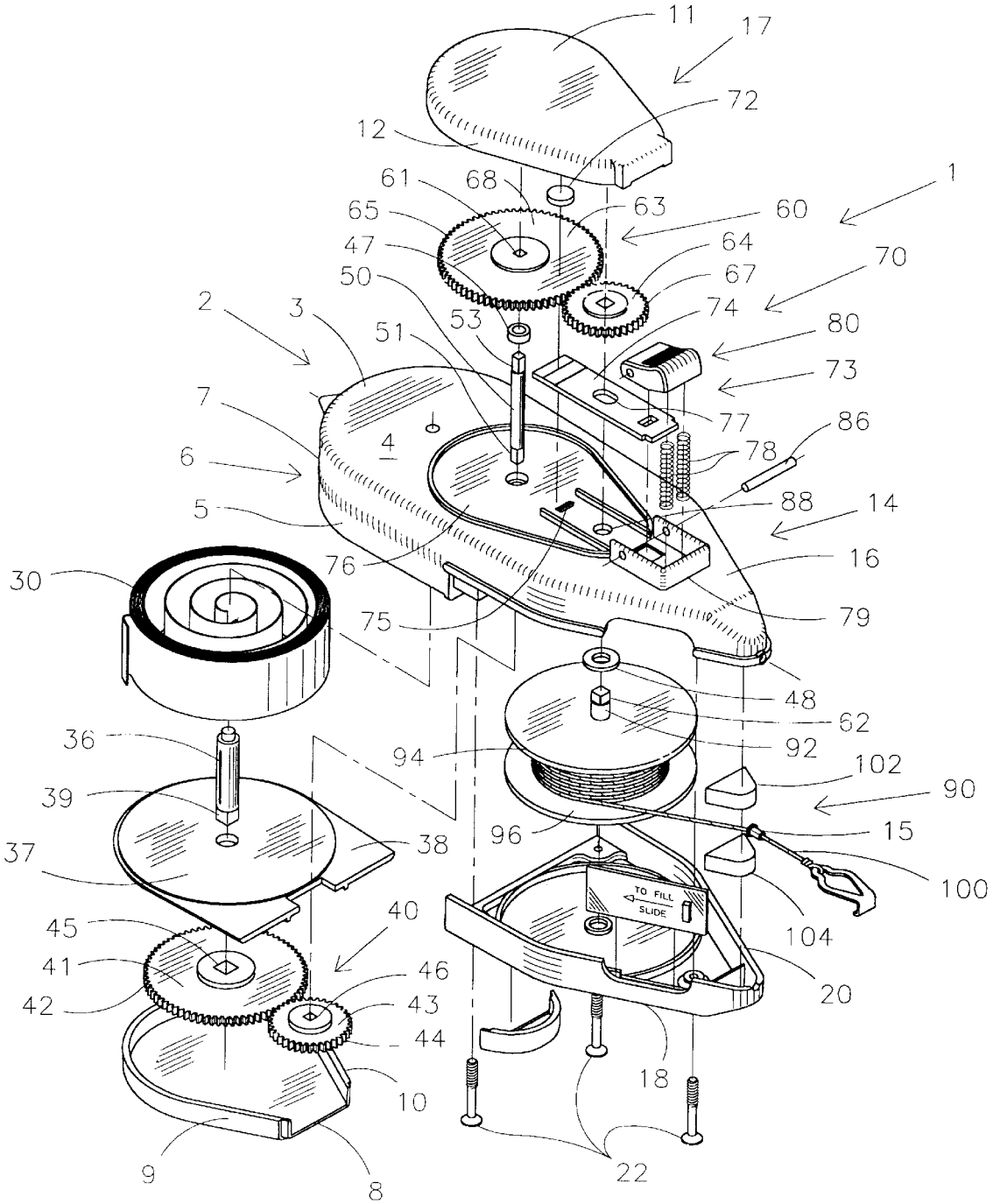
FIG. 1 is an exploded perspective view of the automatically retractable chalk line device of the present invention.
Figure 2:
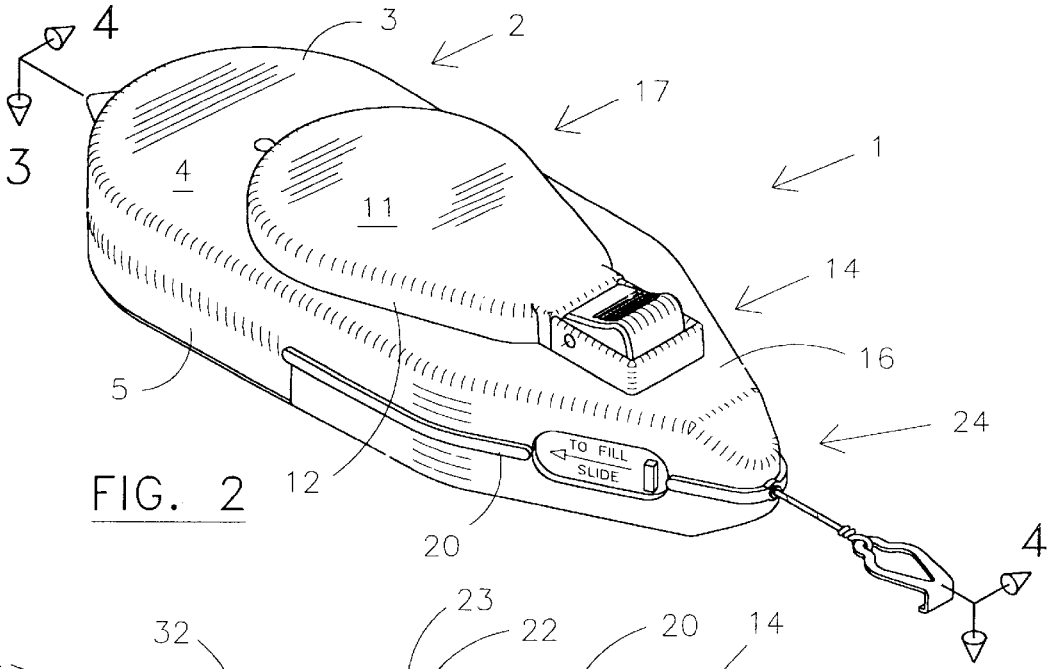
FIG. 2 is a schematic perspective view of the external housing of the chalk line device of the present invention.

The automatically retractable chalk line device of the present invention is indicated in the drawings generally at 1. The assembly includes a housing 2, including a housing body portion 3, having a top surface 4, and a vertical wall 5. The housing 2 includes a spring enclosure portion 6, including an arcuate portion 7. A spring cover 38 captures spring 30 and is integral with the arcuate portion 7 by means of fasteners, integral molding or welding. A bottom plate 8, including vertical portions 9 & 10 is integral with the spring cover 38 by means of fasteners, integral molding or welding.

The housing includes a top assembly 17, including a top member 11, having downwardly extending sides 12. A spool retainer portion 14, includes a extension of body portion 3 indicated at 16, a bottom plate 18, which supports the spool including shoulder 20. Mechanical fasteners 22 hold the assembly together through openings 23, illustrated in FIG. 3.

A chalk line discharge portion 24 includes downwardly and inwardly extending walls 26 & 28 terminating in a vertical wall 29, having an opening 29*a* which includes a wear guide bushing 15 through which the chalk line exits.

Figure 3:
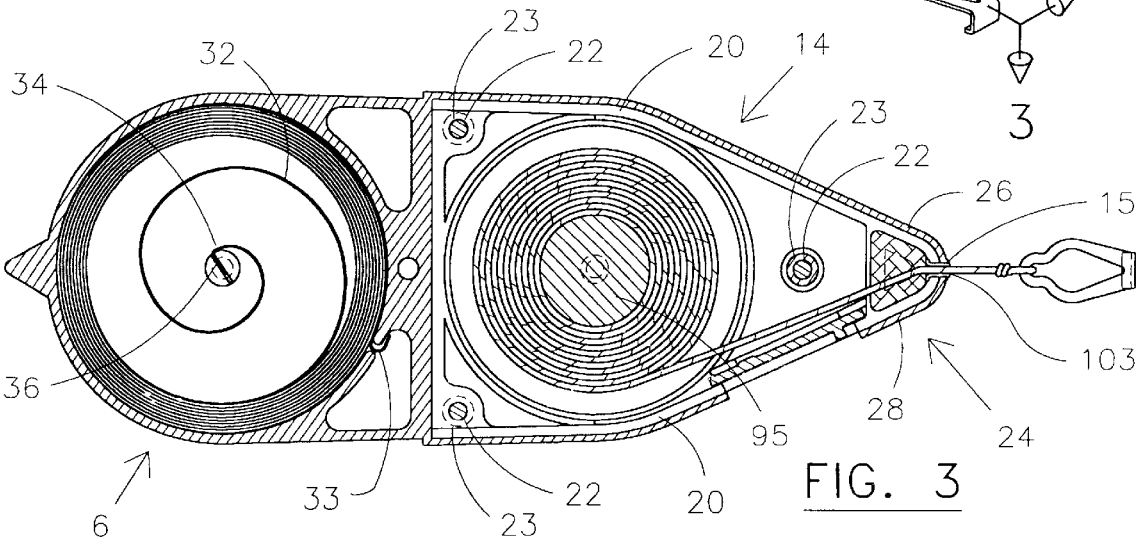
FIG. 3 is a horizontal sectional view looking in the direction of the arrows along line 3—3 in FIG. 2.
Figure 4:
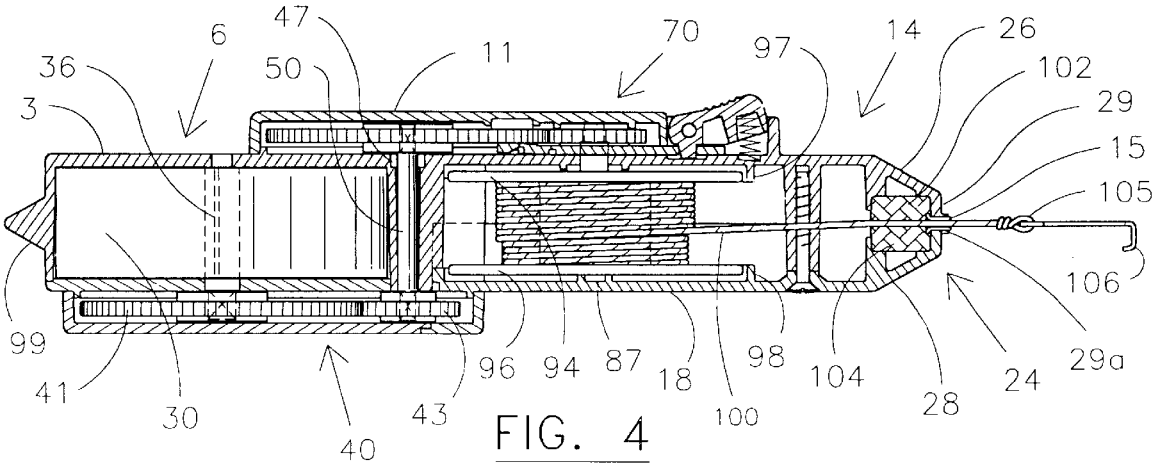
FIG. 4 is a vertical sectional view looking in the direction of the arrows along line 4—4 in FIG. 2.

A power spring 30 includes a plurality of coils 32 and a housing body portion 3 includes a coil retainer 33 (FIG. 3). The spring includes an inner end 34 which engages a spring shaft, 36 which extends vertically through the spring 30 and engages a first gear assembly indicated generally at 40. A spring cover 38, which consists of a protuding bearing surface 37 is located between the spring and the gear assembly 40 (FIG. 1).

The gear assembly 40 includes a large gear, 41 having teeth 42, which engage a small gear 43, having teeth 44 (FIG. 1). Shaft 36 mechanically engages large gear 41 through non-round projection 39 on the shaft and non-round opening 45 on the large gear. Bottom plate 8 captures the gear assembly in place. The difference in diameter between large gear 41 and small gear 43 provides a substantial mechanical advantage.

Small gear 43 includes a non-round opening 46 which receives a shaft 50, through bearing 47 and housing 2, having a non-round end portion 51. Vertical shaft 50 includes a non-round upper end portion 53, which engages a non-round opening 61, in gear assembly 60. Non-round opening 61 is located within a large gear 63 which has teeth 65 which engages small gear 64 having teeth 67. Small Gear 64 having a non-round opening receives spool shaft portion 92, which has a non-round end portion 62, through seal 48 and housing 2. Seal 48 prevents chalk contamination of brake assembly 70.

Figure 5A:
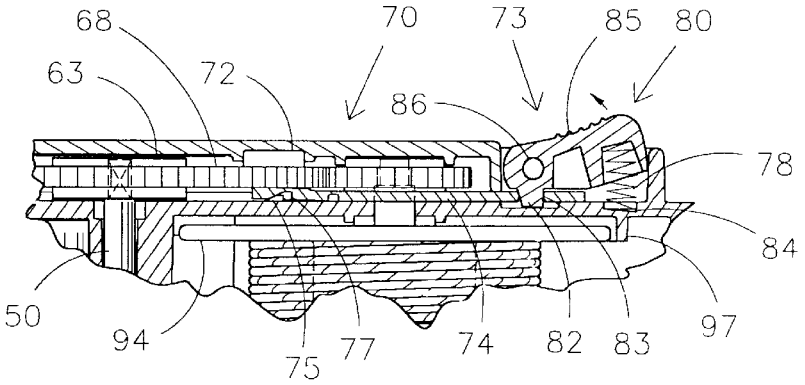
FIG. 5A is a partial vertical sectional view illustrating the brake activating mechanism with the brake in the activated position.
Figure 5B:
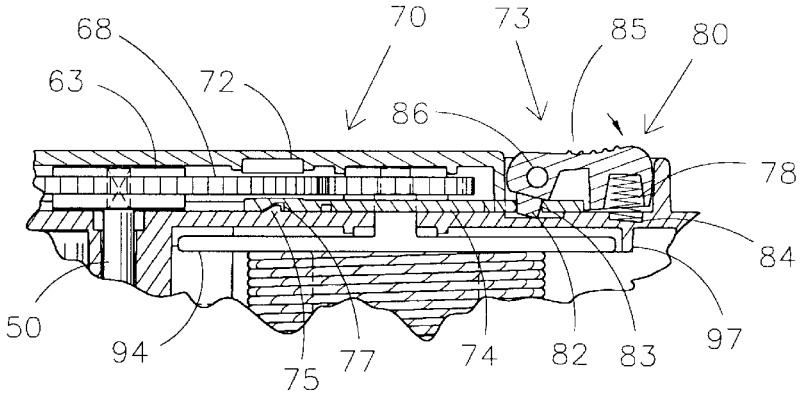
FIG. 5B is a view similar to FIG. 5A with the brake in the deactivated position.

A brake assembly 70 is provided including a brake pad 72 which in engaged position engages the large gear surface 68 and in disengaged position is spaced therefrom as illustrated in FIGS. 1 and 5B. The brake pad 72 is integrally connected to top cover 11 and is nonmoveable. Gear assembly 60 is provided with limited vertical movement on shaft 50 to provide the relative movement between brake pad 72 and gear 63.

A brake activating assembly 73 includes a horizontally moveable plate 74 which is movable over a cam surface 75 located on horizontal housing surface 76. Plate 74 includes an opening 77 for passage of spool shaft 92 to engage small gear 64. A pair of resilient springs 78 held in place with spring cavity 84, within rectangular wall housing 79 resiliently bias a release button 80 into a position wherein button release projection 82 engages an opening 83 in plate 74 to maintain the plate 74 and gear 63 in the engaged position with disc 72. Release button 80 rotates about pivot shaft 86, which is captured across rectangular wall housing 79.

The spool assembly indicated generally at 90 includes a upper spool shaft 92 extending upwardly from an upper plate 94 and a lower spool shaft 87 extending downwardly from bottom plate 96. A spool core 95 extends between upper plate 94 and bottom plate 96 to hold the chalk line 100 in place. Upper spool shaft 92 engages housing 2 through circular hole 88 of top surface 4. Lower spool shaft 87 is integral with bottom plate 18, allowing free rotation. Upper plate 94 and bottom plate 96 fit within formed shoulders 97 and 98, guiding chalk line 100 inside upper plate 94 and bottom plate 96.

Figure 6A:
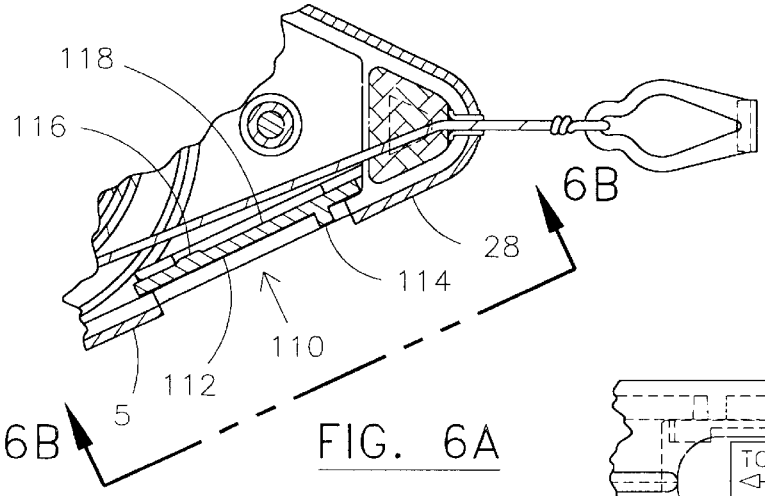
FIG. 6A is view partial horizontal sectional view illustrating the movable plate to allow insertion of chalk into the assembly.
Figure 6B:
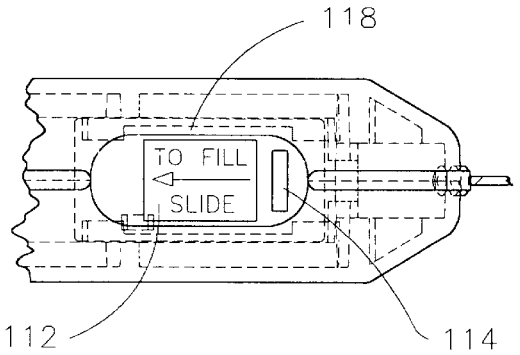
FIG. 6B is a vertical sectional view looking in the direction of the arrows along the line 6B—6B in FIG. 6A illustrating details of the movable plate assembly.
Figure 7:
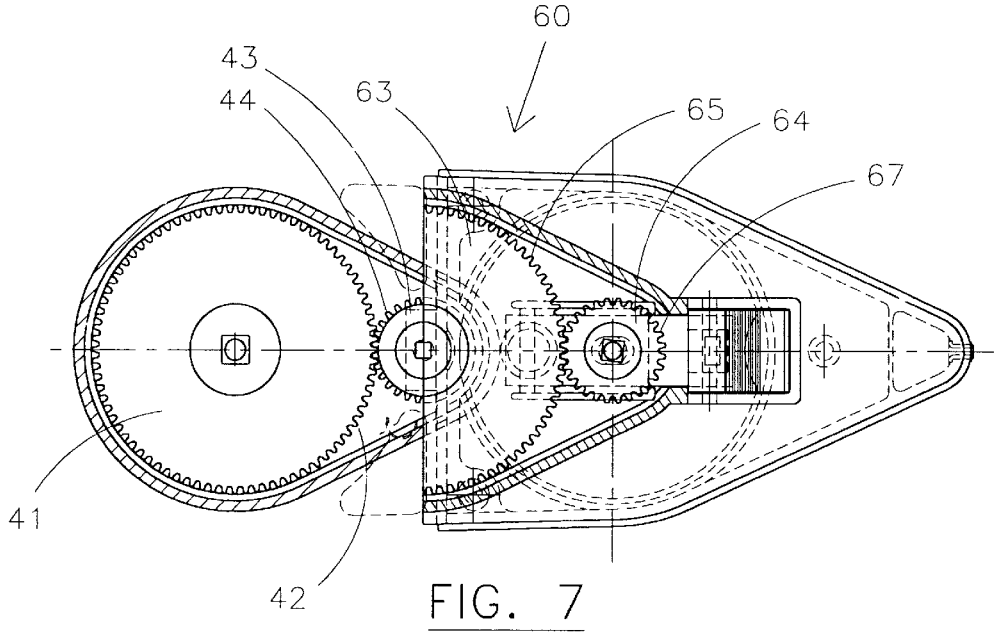
FIG. 7 is a horizontal sectional view looking in the direction of the arrows along the line 7—7 in FIG. 8.
Figure 8:
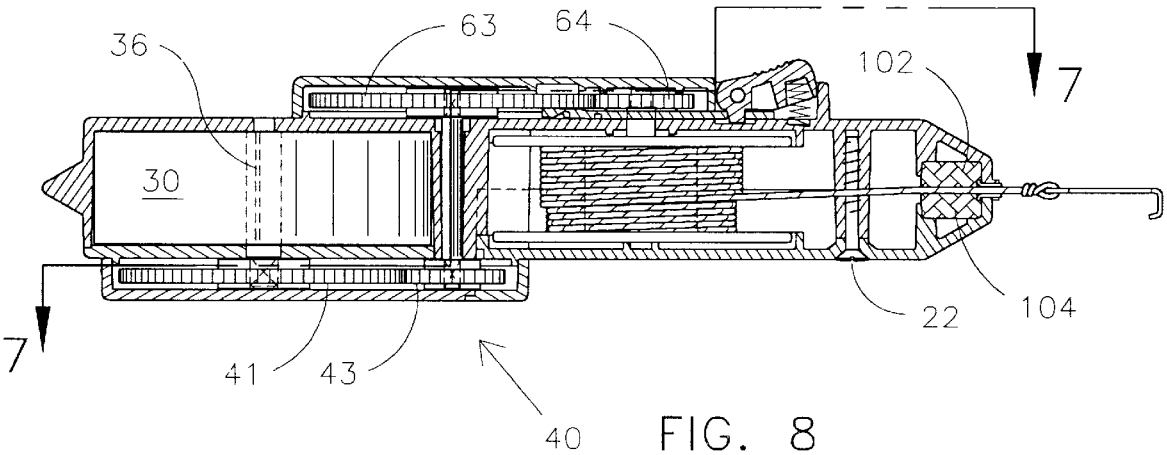
FIG. 8 is a vertical sectional view looking in the direction of the arrows along the line 4—4 in FIG. 2, with the chalk line removed.

The chalk line 100 passes between chalk line retainers 102 and 104 then through wear guide bushing 15 connecting to an anchor 106 by the use of a knot 105. The housing 2 includes an opening 110 as illustrated in FIG. 6A for insertion of chalk. A plate 112 is mounted for movement back and forth to open and close this opening. The plate includes a projection 114 for moving the plate back and forth. The plate is also provided with another projection 116 which engages a slot 118 in the housing to maintain the plate in the closed position.

To open the housing to receive chalk the projection 114 is grasped and sufficient force is provided to overcome the interference fit with the projection 116 and the slot 118 and plate 112 is moved from right to left in FIG. 6A.

FIG. 5A shows the brake assembly 70 in the engaged position in which the brake pad 72 is in engagement with the surface 68 on the large gear 61. In this position the manual release button 80 is in the position shown with the projection 82 located within the plate slot 83.

To release the brake, the manual release button 80 is rotated with the grip portion 85 in a clockwise direction against the bias of the spring 78. This forces the plate 74 from right to left so that the slot 77 is located upon the cam 75 and thereby allowing clearance between the brake pad 72 and the large gear surface 68.

In the operation of the automatic retractable chalk line device, to fill the device with chalk, the plate 112 is moved from right to left in FIG. 6A and the chalk is then poured into the housing through opening 110 so as it will engage the chalk line 100 as the chalk line exits the housing. After filling the housing the plate is moved from left to right in FIG. 6A until the projection 116 engages the slot 118 to hold the plate in the closed position. The anchor 106 is connected to a suitable anchor position in line with the chalk line to be prepared. The operator then moves from right to left in FIGS. 1 to 4 and in so doing the chalk line is rotated about the core 95 to extend the chalk line. In so doing the power coil spring 30 is tensioned. When the chalk line has been removed sufficiently to draw the line for the distance desired, the line is snapped in a manner similar to engaging a string instrument and the chalk forms the desired line.

To retract the line, the manual release button 80 is pivoted in a clockwise direction by the operator engaging the grip portion 85 and the plate 74 moves from right to left in FIGS. 5A and 5B whereby the cam surface 75 is located within the slot 77 of the plate, providing clearance between the brake pad 72 and the large gear 61. The power coil spring 30 is then free to unwind within the housing. This results in shaft 36 driving large gear 41 and small gear 44. Small gear 44 in turn drives shaft 53 and large gear 61. Large gear 61 drives small gear 64. Small gear 64 in-turn drives the spool shaft 92, which causes the chalk line 100 to be rotated back into the loaded position.

The advantages of the present invention are apparent. In the first place the chalk line is fully retractable through the action of the power coil spring and driven gears. Secondly, the disc brake 72 acting on the large gear 61 provides extremely effective disc brake arrangement. Thirdly, the large difference in diameter between the respective gears, 41 and 44, and 61 and 64 provides a large mechanical advantage for the gear system. Fourth, the location of the three shaft axis 36, 50 and 92 provide a balanced arrangement within the housing to allow centered point 99 to be used as a blumb bob. Fifth, the location of the two sets of gears, one in the lower portion of the housing 41, 43 and the location of the second gear arrangement 61, 64 in the upper portion of the housing provides further balance for the chalk line device. Sixth, with the arrangement of the present invention, the chalk line length of 100 feet can be utilized, it is believed this represents a significant distance improvement over prior art chalk line devices.

As an example, the power coil spring has a diameter of 3 inches, and is 1/64 inch in thickness. Large gears 41 and 61 conveniently have a diameter of 2 and 9/16 inches and small gears 44 and 64 conveniently have a diameter of 15/16 inch.

What is claimed is:

1. An automatically retractable chalk line device comprising: a power spring mounted for rotation about a first axis; said coil spring engaging a first vertically extending shaft within said coil spring and engaging a first large gear;

said first large gear being in driving engagement with a first small gear; said first small gear being in driving engagement with a second vertically extending shaft; said second shaft being in driving engagement with a second large gear; said second large gear being in driving engagement with a second small gear, laterally spaced therefrom; said second small gear being in driving engagement with a vertically extending spool shaft; said spool shaft being integral with a chalk line spool; said chalk line spool having a chalk line wound about a chalk line core; said chalk line extending outwardly from said spool and having means for anchoring said chalk line located outside said retraction device housing; brake means for maintaining said power spring in tension position; and means for releasing said brake means to allow said power spring to drive said first large gear, said first small gear, said second large gear, said second small gear, and said spool to retract said chalk line.

2. A device according to claim 1 wherein the said brake means comprises a disc brake arrangement.

3. A device according to claim 2 wherein said disc brake arrangement comprises a disc member which engages one of said gears.

4. A device according to claim 3 wherein said disc member engages one of said large diameter gears.

5. A device according to claim 4 wherein said means for releasing said brake system comprises a cam surface and a moveable plate.

6. A device according to claim 5 wherein said moveable plate contains a slot; said slot in one position is located relative to said cam surface to provide clearance between said gear and said disc brake.

7. A device according to claim 6 wherein said plate is activated by a pivotable release button.

8. A device according to claim 7 wherein said plate contains a second slot and wherein said manual release button contains a projection and wherein in braking position said projection engages said second slot.

9. A device according to claim 8 wherein said release button is manually activatable to move said plate such that said cam surface is located within said slot to release said brake.

10. A brake system for a chalk line device comprising; a chalk line spool containing a chalk line; said spool having a spool shaft extending outwardly from said spool; said spool shaft engaging a gear system; said gear system including means for driving said gear system; said gear system including at least one gear being engageable with a disc brake to maintain said gear system and said spool in the braked position.

11. A brake system according to claim 10 wherein said gear engageable with said disc brake is a large diameter gear.

12. A brake system according to claim 11 wherein means are provided to engage and disengage said disc brake with said large diameter gear.

13. A brake system according to claim 12 wherein the means for causing engagement and disengagement comprises a cam surface and a movable plate.

14. A brake system according to claim 13 wherein said movable plate contains a slot and wherein means are provided for moving said plate into a position whereby said cam surface is located within said slot and said large diameter gear no longer engages said disc brake.

15. A brake system according to claim 14 wherein said plate is movable by a release button.

16. A brake system according to claim 15 wherein release button engages said slot in said plate when said brake is in brake position.

* * * * *